US005899029A

United States Patent [19]

Spahr

[11] Patent Number: 5,899,029

[45] Date of Patent: May 4, 1999

[54] SUPPORT STRUCTURE FOR FLOOR PLATES

[76] Inventor: Manfred Spahr, Waiblinger Strasse 63, D-70372 Stuttgart, Germany

[21] Appl. No.: 08/729,887

[22] Filed: Oct. 11, 1996

[30] Foreign Application Priority Data

Nov. 11, 1995 [DE] Germany ..... 195 42 155

[51] Int. Cl.[6] ..... E04B 9/00

[52] U.S. Cl. ..... 52/126.5; 52/263; 52/126.6

[58] Field of Search ..... 52/126.5, 126.6, 52/127, 263

[56] References Cited

U.S. PATENT DOCUMENTS

| | | | |
|---|---|---|---|
| 2,956,653 | 10/1960 | Liskey, Jr. | 52/126.6 X |
| 4,277,923 | 7/1981 | Rebentisch et al. | 52/126.6 |
| 4,922,670 | 5/1990 | Naka et al. | 52/126.6 |
| 4,982,539 | 1/1991 | Hiller | 52/126.6 X |
| 5,477,649 | 12/1995 | Bessert | 52/126.6 X |

FOREIGN PATENT DOCUMENTS

| | | | |
|---|---|---|---|
| 0352343 | 1/1990 | European Pat. Off. . | |
| 0563505 | 10/1993 | European Pat. Off. . | |
| 1222681 | 6/1960 | France . | |
| 2567945 | 1/1986 | France . | |
| 3514024 | 3/1987 | Germany | E04F 15/024 |
| 2185048 | 7/1987 | United Kingdom . | |

OTHER PUBLICATIONS

"Schöner Wohen" Aug. 1995, pp. 109–114.

Mahle brochure "Doppelboden".

*Primary Examiner*—Creighton Smith

*Attorney, Agent, or Firm*—Paul J. Vincent

[57] ABSTRACT

With a support structure (30) for floor plates (32) elongated frieze members (20) meet together in the vicinity of their ends and form individual mutually connected frames (31). The frames (31) are arranged at a separation from a mounting surface (21) of the support structure (30) via spacer elements (16) and hold floor plates (32). The mutually meeting ends of the frieze members (20) have sidewardly disposed angle brace components (10, 11) by means of which the individual frieze members (20) are connected to each other in a detachable fashion with the assistance of connecting elements (15). The spacer elements (16) are attached to the angle brace components (10, 11) in an adjustable and detachable fashion. In this manner adjustment of the horizontal orientation of the floor plates (32) is also possible after complete assembly of the support structure (30). The support structure (30) is permanent and weather-resistant.

12 Claims, 3 Drawing Sheets

SUPPORT STRUCTURE FOR FLOOR PLATES

BACKGROUND OF THE INVENTION

The present invention concerns a support structure for floor plates with which elongated frieze members meet at their ends to form individual mutually connected frames which are disposed at a separation from a mounting surface of the support structure by means of spacer elements and which hold the floor plates.

A support structure of this type for floor plates has become known in the art through the brochure "Double flooring" of the company Mahle GmbH from March 1995.

When introducing a floor covering onto a floor of a building, which, for example, is constructed from concrete or stone plates, a support structure is normally utilized which facilitates the introduction of a floor covering above the floor in the form of a second double flooring. This is done for a plurality of reasons. For example, a flooring made from concrete or stone has a rough surface and leaves a cold and hard impression on the observer. The installation of a second flooring facilitates an improved optical and esthetic effect. Cables, leads, pipes and the like are often disposed in or above the floor and must also be covered.

The installation of floor plates with the assistance of support structures is, in particular, done for terraces, balconies, in winter gardens, and in exhibition halls and rooms. Towards this end, on the one hand, a good resistance to weather conditions on the part of the support structure and, on the other hand, a rapid and easy installation of the support structure are desirable.

The support structure for floor plates which has become known in the art through the brochure of the company Mahle utilizes individual support elements onto which frieze members can be attached. These frieze members form a frame or grid for mounting the floor plates which is difficult to screw together. The support elements have, on the one hand, a support function and, on the other hand, serve as spacer elements which can be directed longitudinally facing the mounting surface of the support structure. In this fashion unevenness in the flooring can be compensated for so that the floor plates always are in a horizontal position. Disadvantageously, the length of the support elements can only be adjusted from below so that the adjustment of the length of the spacing bolts can only be done when the floor plates are removed and/or when portions of the support structure are disassembled. As a result it is difficult and expensive to precisely install a plurality of coplanar floor plates.

Since the support elements of the conventional support construction have only limited intrinsic strength, an additional attachment of the support structure to the side walls is usually necessary. The support structure can therefore not be assembled as a freely self-supporting floor covering on only one portion of the floor.

In other conventional support structures for floor platings known from the journal "Schöner Wohnen" (Gruner+Jahr Publishing House) volume 8, 1995, a floor grid made of wood is utilized with which the individual grid members are attached to each other using nails and dowel means. The floor grid is, for example, installed on a gravel bed or on a stone floor for supporting a floor covering comprising individual floor plates. The individual components of the support structure which are connected to each other in this manner do not, however, guarantee that the floor plates maintain their precise orientation over a long period of time under wear conditions. In the event that floor plates made of wood are utilized, there is always the danger of damage to the floor plates caused by moisture collecting below the floor plates.

Floor plates made, for example, from stone or ceramic are also directly connected with the ground using mortar and grouting for terrace and balcony applications so that there is no free space available between the ground and the floor plating. If dampness then penetrates between the floor plating and the ground as a result of weather conditions, same can lead to stresses and strains between the floor plating and the ground so that crack formation and damage to the floor plating results. This occurs in particular in winter under freezing conditions when the moisture below the floor plating freezes and the ice expands. As a result repair of the floor plating must always be carried out and is unavoidable.

It is therefore the purpose of the present invention to further improve the conventional support structure for floor plating in such a fashion that adjustable horizontal orientation of the floor plates is also possible following complete assembly of the support structure, with the support structure being weather resistant and permanent.

SUMMARY OF THE INVENTION

This purpose is achieved in that the mutually joining ends of the frieze members have sidewardly disposed angle brace components for connecting the individual frieze members to each other in a disconnectable fashion with the assistance of connecting elements, the spacer elements being mounted to the angle brace components in a detachable and adjustable fashion.

The support structure in accordance with the invention can be assembled in a simple manner by orienting the ends of the frieze members with respect to each other in such a fashion that the sidewardly disposed angle brace components come into contact with each other and seat on top of each other. When a connecting element, for example a pin or a screw, is attached to the two angle brace components, the frieze members are connected to each other in a detachable fashion. Starting from two individual frieze members it is thereby possible to assemble the entire support structure in this fashion. Four frieze members constitute a common frame, in which a floor plate can be inserted and held.

Since the spacer elements are preferentially insertable into the angle brace components from above and attached to same in a detachable fashion, the distance between the frieze members and the mounting surface can be easily changed from above.

The support structure in accordance with the invention can be assembled in a rapid and straightforward fashion and be utilized a plurality of times. It is likewise conceivable to utilize the support structure for floor plates for the covering of a floor of a terrace or a balcony as well as within an exhibition hall or a marquee. Since the support structure is particularly stable it can also be used in applications involving large loads or having large stresses and strains.

In the event that the support structure is assembled outdoors, for example on terraces or balconies, it is possible for rain water incident on the floor plating to drain off through openings between the frieze members. The air circulation between the mounting surface and the floor plates additionally guarantees good ventilation of the support structure which is, for example, desirable when utilizing floor plates made from wood.

When assembling the support structure for floor plates it is particularly advantageous for the angle brace components to have protruding shoulders on which the floor plates are attached. It is advantageous when the floor plates are simply inserted from above into the frames defined by the frieze members to seat on and be held by the protruding shoulders of the angle brace components. In the event that recesses are provided for in the edge regions of the floor plates, the protruding shoulders can engage into these recesses so that a particularly stable positioning of the floor plates between the frieze members is effected which is nevertheless easily detachable.

The stability of the mutually connected frieze members is increased to an even further extent when the two angle brace components arranged at the sides of the frieze members are connected to each other via a brace hanger engaging the frieze member.

In a particularly preferred embodiment two angle brace components are attached on opposite sides of a frieze member, in each case, in such a manner that a lower edge of one angle brace component is disposed at the height of an upper edge of the other angle brace component. The displaced vertical configuration of the angle brace components causes the angle brace component of one frieze member to seat on another angle brace component when the support structure is assembled and an angle brace component likewise seats on the other angle brace component of this frieze member. As a result the angle brace components are connected to each other in a dove-tailed manner to substantially increase the stability of the entire support structure.

An advantageous embodiment provides for rigid connection between the angled brace component engaging one end of the frieze member and the angled brace component engaging the other end of that frieze member. This measure has the advantage of allowing for more precise relative positioning of the angled brace components at opposite ends of a frieze member.

In an additional embodiment, the angle brace components comprise three side elements connected to each other into a triangle in which a preferentially cylindrically shaped pipe section is attached, preferentially welded, for acceptance of the connecting elements. Since the angle brace component has a hollow profile cross-section, the connecting elements and spacer elements can be introduced from above through the angle brace component and be attached in a particularly simple fashion. This facilitates an adjustment of the length of the spacer elements with respect to the mounting surface of the support structure which can be carried out from above the floor plates.

In an improvement of this embodiment a thread is fashioned in the pipe member for acceptance of the connecting elements so that assembly of the support structure is particularly easy to carry out.

The ease of handling of the support construction is substantially determined by the accessibility of the connection of the individual angle brace components to each other. For this reason it is particularly advantageous when the connecting elements are configured as tapped or threaded bushings in which the spacer elements are held.

Since the load of the support structure is carried by the spacer elements it is necessary for the spacer elements to be of stable construction while nevertheless being easy to handle. This is achieved in a particularly simple fashion when the spacer elements are either hollow or bolt-shaped.

In the event that the support structure is also to be utilized outdoors with the base of the mounting surface being soft or, for example, sandy it is advantageous for support bases to be attached to the spacer elements.

In a further embodiment the floor plates are made from wood and have a border made from a metallic material. Since the floor plates of the support structure in accordance with the invention are separated from a mounting surface of the support structure, good air circulation is present below the floor plates to facilitate the utilization of floor plates made from wood without rotting or decay taking place below the floor plates. The mounting of the floor plates is strengthened in an advantageous fashion when the protruding shoulders of the angle brace components engage into the metallic border of the floor plates. The utilization of floor plates made from wood results in a particularly esthetic effect such as, for example, is given by the deck of a ship. It would, for example, be conceivable to cover the floor of a winter garden with the assistance of the support structure in accordance with the invention using floor plates made from tropical wood or teak wood.

It is likewise particularly preferred when the frieze members are made from wood and have a grain disposed perpendicular to the plane of the floor plates. The orientation of the grain, caused by the perpendicularly disposed annular rings of the wood, provides for an excellent stability and long lifetime of the frieze members.

In the event that the frieze members are produced from metal, preferentially light metal, it is possible for the support structure in accordance with the invention to be of light construction while nevertheless having sufficient stability.

A method for using the support structure for floor plates as flooring for terraces and balconies, dance flooring or marquee flooring is also within the framework of the present invention. The support structure in accordance with the invention also allows for the covering of individual floor areas. For example, a walk way platform for fashion shows or receptions or the like can be assembled by means of the support structure.

Further advantages of the invention can be derived from the description and the drawing. The above-mentioned features and those to be further described below can be utilized in accordance with the invention individually or collectively in arbitrary combination. The embodiments shown are not to be considered as an exhaustive enumeration, rather have exemplary character only for illustration of the invention.

The invention is represented in the drawings and will be more closely explained using an embodiment.

DESCRIPTION OF THE PREFERRED EMBODIMENT

Figure 1:
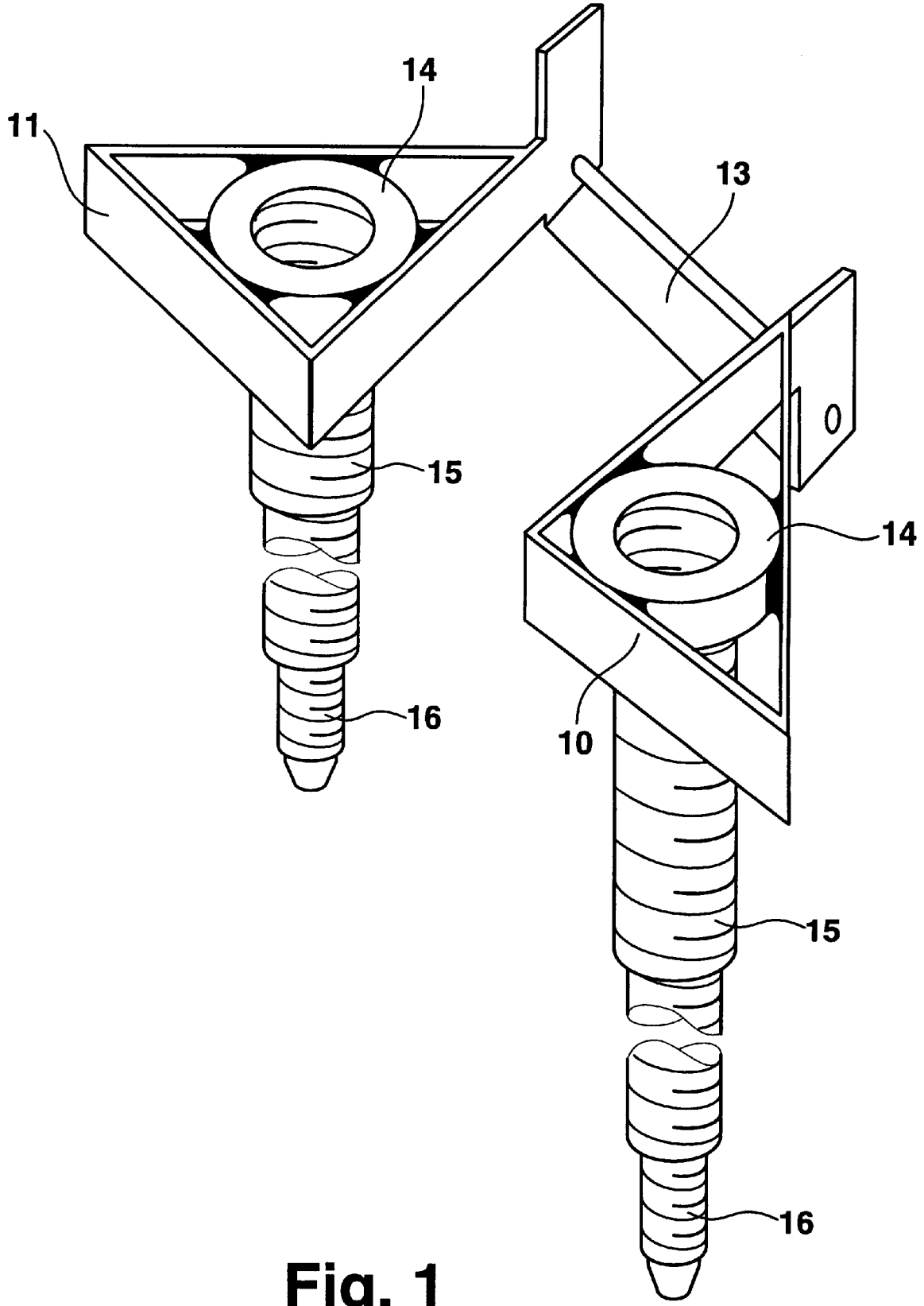
FIG. 1 shows a perspective view of two angle brace components of a support structure for floor plates in accordance with the invention.

The figures in the drawing show the object of the invention in a partially highly schematic fashion and are not to be taken to scale.

FIG. 1 gives a perspective representation of two angle brace components 10 and 11 of a support structure in accordance with the invention. The angle brace components 10 and 11 are connected to each other via a brace hanger 13. A frieze member of the support structure can be attached between the brace components 10 and 11.

The angle brace components 10 and 11 have heights which are displaced with respect to each other so that mutually connected frieze members always have an upwardly seated and a downwardly seated angle brace component 10 and 11. The angle brace components 10 and 11 have a hollow profile of triangular cross-section. A pipe member 14 is attached inside of the triangle of the angle brace components 10 and 11, in each case, which serves for the reception of a connecting element 15 (schematically sketched in the figure) for connecting two vertically stacked angle brace components 10 and 11. A thread is formed in pipe members 14 so that connecting elements 15 can be screwed into the pipe members 14 from above or from below.

After attachment of two angle brace components 10 and 11 by means of a connecting element 15, a spacer element 16, which is likewise only schematically indicated in the figure, is attached to the connecting elements 15.

The stability of the attachment of the angle brace components 10 and 11 to the frieze member is increased in that the angle brace components 10 and 11 are connected to each other via the brace hanger 13.

Figure 2:
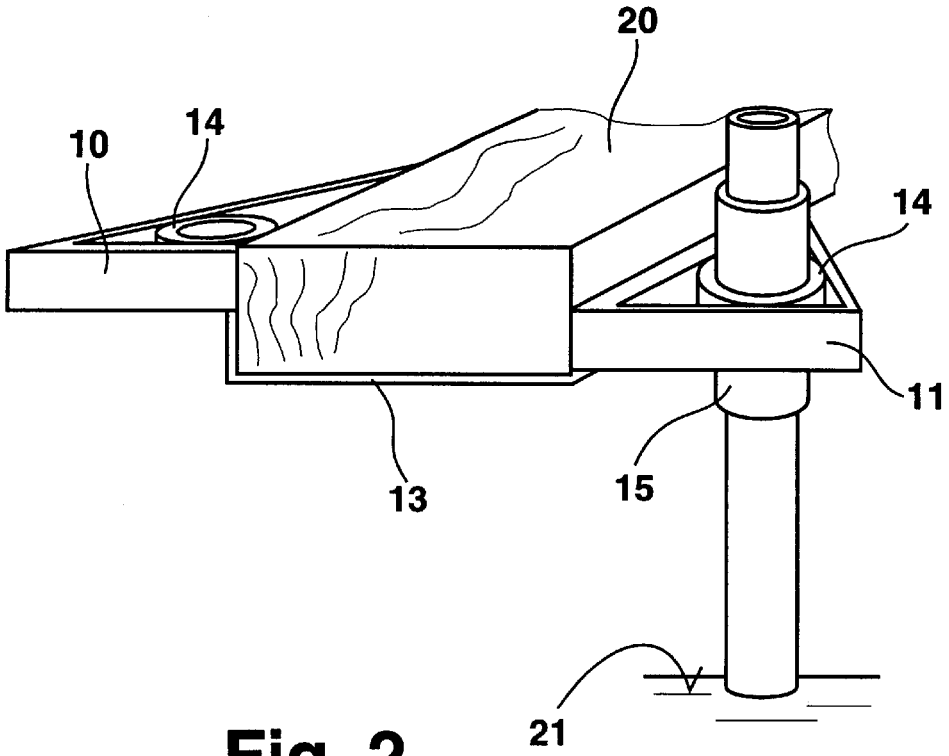
FIG. 2 shows a perspective view of a frieze member having angle brace components according to FIG. 1 attached thereto.

FIG. 2 shows a perspective view of components of a support structure in accordance with the invention. The angle brace components 10 and 11 are disposed at the sides of a frieze member 20 made from wood and having an annular ring grain orientation perpendicular to the longitudinal axis of the frieze member 20. The angle brace components 10 and 11 are vertically displaced with respect to each other and attached to the frieze member 20 by means of a screw connection so that mutually connected frieze members 20 always have an upper and a lower angle brace component 10 and 11. The angle brace components 10 and 11 have a hollow profile which is triangular in cross-section. The pipe member 14 is attached within the triangle of the angle brace components 10 and 11 and serves for receiving a connecting element 15 for connecting two angle brace components 10 and 11. A thread is formed in pipe member 14 so that the hollow connecting element 15 can be screwed into the pipe member from above.

After attaching two angle brace components 10 and 11 using the connecting element 15, a spacer element 16 is screwed into the hollow connecting element 15 so that the support structure, as suggested in the figure, can stand on a mounting surface 21.

The stability of attachment of the angle brace components 10 and 11 to the frieze member 20 is increased when the angle brace components 10 and 11 are connected to each other via the brace hanger 13.

Figure 3:
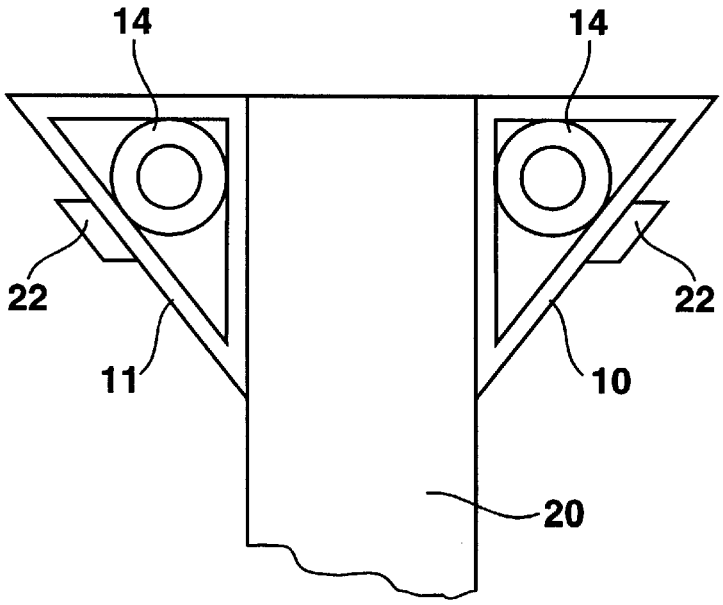
FIG. 3 shows a plan view of the frieze member in accordance with FIG. 2.

FIG. 3 shows a plan view of the frieze member 20, to the side of which the angle brace components 10 and 11 are attached. The angle brace components 10 and 11 have a hollow profile of triangular cross-section. Pipe members 14 are attached within these triangles and serve for receiving the connecting elements and spacer elements as described in FIG. 2. Sideward shoulders 22, to which the floor plates can be attached, are formed on the angle brace components 10 and 11. The floor plates can simply be inserted from above into the frames defined by the frieze members 20 to seat on and be held by the protruding shoulders 22 of the angle brace components 10 and 11. In the event that recesses are provided for in the border regions of the floor plates, the protruding shoulders 22 can engage into these recesses so that a particularly stable positioning of the floor plates between the frieze members 20 is achieved which is nevertheless easily detachable.

Figure 4:
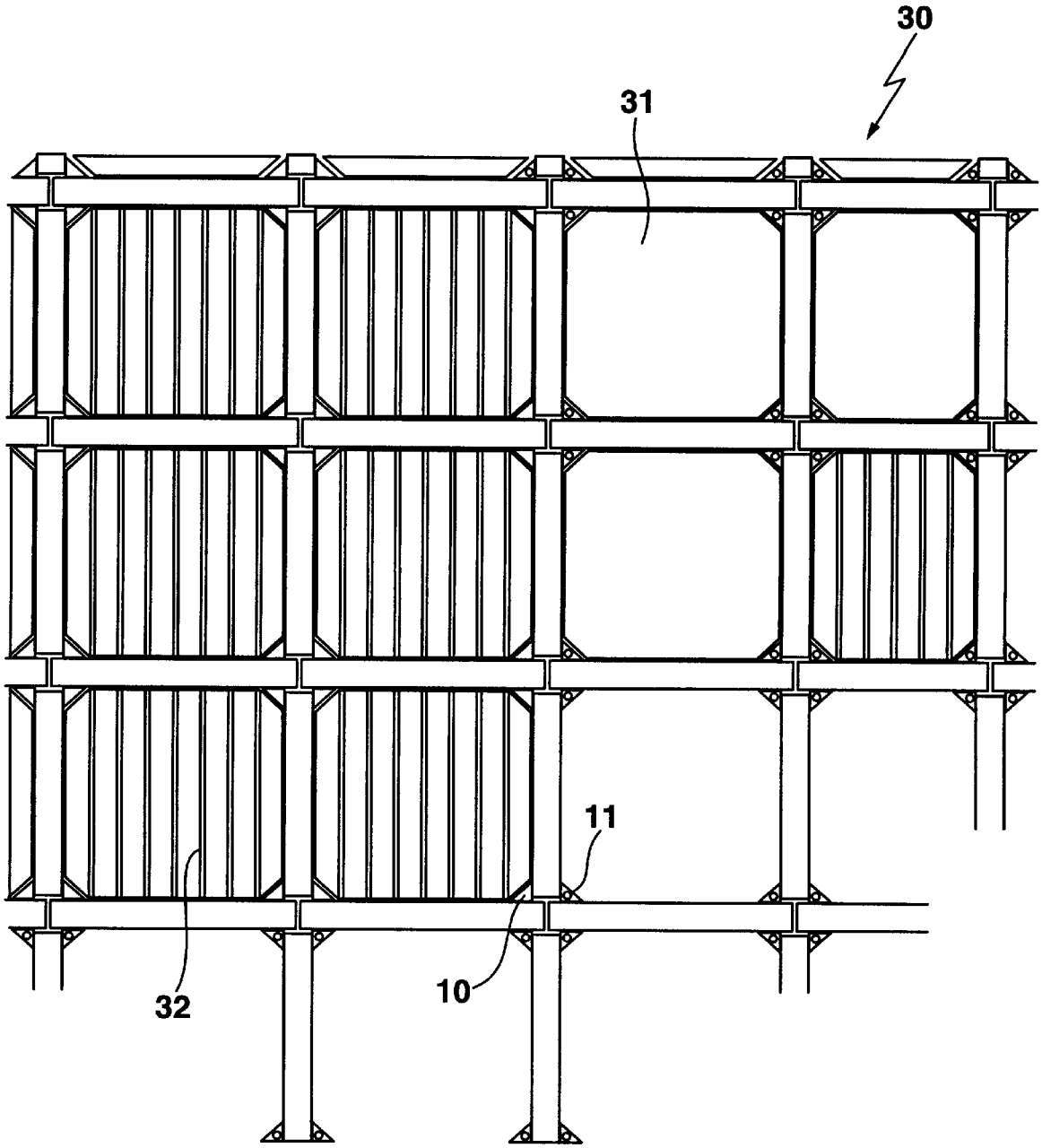
FIG. 4 shows a plan view of the support structure for floor plates in accordance with the invention in the assembled state.

FIG. 4 shows a plan view of the support structure 30 in accordance with the invention in an assembled state. The support structure 30 has a grid-shaped structure fashioned by the frieze members 20 connected to each other via their angle brace components 10 and 11, with the frieze members 20 forming individual mutually connected frames 31. Floor plates 32 made from wood are inserted into the frames 31 so that a floor structure comparable to that of the deck of a ship is effected. The floor plates 32 have bevelled edges and are framed by a metallic border. Since protruding shoulders are formed on the angle brace components 10 and 11 which engage into the border of the floor plates 32, the floor plates can be easily lowered within the frames 31 so that their upper surface is contiguous with the upper surface of the frieze members 20. The connecting elements and spacer elements, as shown in FIG. 2, can be introduced from above and attached in this assembled state of the support structure 30 for floor plates 32. This facilitates an easily detachable rapid assembly as well as disassembly of the individual components of the support structure 30.

I claim:

1. A flooring system having an upper flooring surface with a grid-like appearance, the flooring system comprising:

elongated frieze members;

an angled brace means engaging sides of a frieze member to hold and join said frieze members in a detachable fashion, said joined frieze members each forming a frame, said angled brace means comprising a first angled member adjacent to a first side of said frieze member, a second angled member adjacent to a second side of said frieze member, and a brace hanger connected between said first and said second angled members;

a floor plate inserted within said frame formed by said joined frieze members, said floor late and said frieze members forming the upper flooring surface; and spacer means extending upwardly to engage said first angled member in a detachable manner.

2. The support structure of claim 1, wherein said angled brace means engage and hold the floor plate.

3. The support structure of claim 1, wherein an upper surface of said first angled member is generally coplanar with a lower surface of said second angled member.

4. The support structure of claim 1, wherein said first and said second angled members each comprise three side elements connected to form a triangle, a pipe member mounted within said triangle, and a connecting member cooperating with said pipe member.

5. The support structure of claim 4, wherein said pipe member and said connecting member are threaded.

6. The support structure of claim 4, wherein said connecting member is tapped or threaded.

7. The support structure of claim 1, wherein said spacer means is hollow.

8. The support structure of claim 1, where said spacer means is bolt-shaped.

9. The support structure of claim 1, wherein said floor plate is made from wood and comprises a border made from a metallic material.

10. The support structure of claim 1, wherein said frieze members are made from wood and have a grain disposed perpendicular to a plane of said floor plate.

11. The support structure of claim 1, wherein said frieze members are manufactured from metal.

12. The support structure of claim 1, wherein the floor plate is adapted for use as one of terrace flooring, balcony flooring, dance flooring and marquee flooring.

* * * * *